United States Patent [19]

Van Niekerk

[11] Patent Number: 5,060,337

[45] Date of Patent: Oct. 29, 1991

[54] HANDBRUSH AND METHOD OF MANUFACTURE THEREOF

[75] Inventor: Gerhard A. Van Niekerk, Pretoria, South Africa

[73] Assignee: Climbminster Limited, West Gorton, United Kingdom

[21] Appl. No.: 479,168

[22] Filed: Feb. 13, 1990

[30] Foreign Application Priority Data

Feb. 15, 1989 [ZA] South Africa ..... 89/1158
Jan. 31, 1990 [ZA] South Africa ..... 90/0718

[51] Int. Cl.[5] ..... A47L 13/12

[52] U.S. Cl. ..... 15/111; 15/143 R; 15/188; 15/236.05; 300/21; 401/39; 401/287

[58] Field of Search ..... 15/110, 111, 143 R, 15/187, 188, 236.01, 236.02, 236.05; D4/118; 401/37, 39, 195, 287, 291; 300/21

[56] References Cited

U.S. PATENT DOCUMENTS

| | | | |
|---|---|---|---|
| 87,070 | 2/1869 | Roberts | 15/188 |
| 120090 | 10/1871 | Osgood | 15/111 |
| 1,012,653 | 12/1911 | Knickerbocker | 15/188 |
| 1,221,261 | 4/1917 | Worth | 15/111 |
| 1,327,757 | 1/1920 | Eggers | 15/188 |
| 1,430,441 | 9/1922 | Forsberg | 15/111 |
| 1,483,760 | 2/1924 | Yoshizawa | 15/111 |
| 1,491,016 | 4/1924 | McGowan et al. | 15/188 |
| 1,746,685 | 2/1930 | Struble et al. | 401/291 |
| 1,963,360 | 6/1934 | Gibbin et al. | 15/188 |
| 4,610,043 | 9/1986 | Vezjak | 15/111 |

FOREIGN PATENT DOCUMENTS

| | | | |
|---|---|---|---|
| 54447 | 3/1938 | Denmark | 15/143 R |
| 491030 | 2/1930 | Fed. Rep. of Germany | 15/111 |
| 867131 | 2/1953 | Fed. Rep. of Germany | 15/188 |
| 150468 | 6/1932 | Switzerland | 15/188 |
| 4200 | of 1881 | United Kingdom | 401/291 |
| 753521 | 7/1956 | United Kingdom | 15/188 |

*Primary Examiner*—Philip R. Coe
*Assistant Examiner*—Mark Spisich
*Attorney, Agent, or Firm*—Berman & Aisenberg

[57] ABSTRACT

A handbrush and method for the manufacture thereof, are disclosed. The handbrush comprises a head having a plurality of bristles thereon and handle extending from the head, the head, the bristles and the handle all being integrally moulded from a polymeric compound such as rubber. A rigid strengthening member may be embedded in the head and the handle and may be bent to impart a desired shape to the brush, e.g. for maintaining the handle at a desired angle to the head. The brush may be provided with a substantially longitudinally extending scraper blade which may also be integrally moulded with the head, the bristles and the handle. In addition, a groove may be provided in the head of the handbrush for receiving and holding an edge of a steel blade for removing ice from the windscreens of motor vehicles or the like.

6 Claims, 3 Drawing Sheets

HANDBRUSH AND METHOD OF MANUFACTURE THEREOF

FIELD OF THE INVENTION

This invention relates to a handbrush and to a method for the manufacture thereof.

BACKGROUND TO THE INVENTION

Various kinds of handbrushes have been used by mankind over many centuries. Still the most commonly known brushes today are those that comprise an elongate head to one end of which is attached a handle, the head comprising a plurality of bristles bound in bundles, each bundle being fixed in a hole provided in the head. The means of fixing could, for instance, include dipping of the bristles in lacquer, pitch or another binding agent and introduction thereof into the holes, or alternatively, by means of staples or the like.

To be able to market handbrushes at acceptable prices, either low-cost labour or else, capital intensive automatic or semi-automatic machines are employed, the latter of which produces large numbers of brushes of the aforementioned kind. However, a disadvantage of such conventional brushes comprising separate bristles is that the bristles are often dislodged from the holes in which they are fixed, especially in the case of brushes of which the heads are made of wood, and where such heads are intermittently used with water, causing the head to swell and contract repeatedly. Other brushes exist in which the head and the bristles are made of plastics materials, with the head having a plurality of receptacles for receiving the bundles of bristles. The bristles of such brushes are usually fixed by heating and subsequent solidification of the plastics material of the head around the bristles.

OBJECTS AND SUMMARY OF THE INVENTION

It is an object of the present invention to provide a handbrush and a method for the manufacture thereof, which comprises the minimum number of separate constituent parts.

It is a further object of the invention to provide a handbrush which can be used not only to brush dry surfaces, such as upholstery, carpets, clothing and the like, but also to assist in washing objects, such as the exterior painted surfaces of a motor vehicle, without scratching, or other sensitive objects, such as cutlery, crockery, glassware and the like.

It is another object of the invention to provide a single tool for brushing dry surfaces, for washing wet surfaces and for removing water from glass surfaces.

Further objects and advantages of the invention will become apparent from a reading of the specification together with the attached drawings.

According to the invention, there is provided a method of manufacturing a handbrush comprising a head, a handle connected to the head and bristles projecting from the head, including the steps of moulding the head, the handle and the bristles as one integral piece from a polymeric compound; and embedding during or after the moulding process, a rigid strengthening member in the head and the handle.

Also according to the invention, there is provided a handbrush comprising a head, a handle connected to the head and a plurality of bristles projecting from the head, in which the head, the bristles and the handle are all integrally moulded in one piece from a polymeric compound and in which a rigid strengthening member is embedded in the head and the handle.

The rigid strengthening member may be bent to impart a desired shape to the brush, e.g. for maintaining the handle at a desired angle to the head of the brush. The strengthening member may comprise a steel, preferably a spring steel, rod. Alternatively, it may comprise a rod made of a suitable polymer or of a fibre, such as glass fibre, asbestos, or the like.

The bristles may be circular in cross-section. Preferably, they are tapered in a direction away from the head. Alternatively, they may be substantially cylindrical in shape, optionally with their free edges chamfered.

The bristles may be arranged in rows. The bristles in one row may be staggered with respect to bristles in adjacent rows. The handbrush may comprise bristles of smaller diameter and bristles of larger diameter, all bristles having substantially the same length. The thinner bristles may be suitable for sweeping smaller dirt particles or dirt particles of smaller individual mass, and by virtue of being thinner, they may promote or facilitate the development of static electricity which in turn may cause the individual bristles to be charged and to attract the or at least some of the dirt particles. The dirt particles may then subsequently be removed by rinsing the handbrush under running water.

The thicker bristles are preferably of greater rigidity than the thinner bristles and may be suitable for sweeping larger particles or particles of greater individual mass than the thinner bristles.

To facilitate their cleaning action, the thicker bristles are preferably arranged in first rows whilst the thinner bristles are preferably arranged in second rows. The second rows may alternate with the first rows, and the thicker bristles of one first row may be staggered with respect to the thicker bristles of adjacent first rows. The thinner bristles of adjacent first rows are conveniently not staggered with respect to one another but are arranged opposite one another.

The head may be elongate in shape and the handle may extend from one end thereof. The head is conveniently provided with a scraper blade, which may also be integrally moulded with the head, the bristles and the handle. The scraper blade may extend longitudinally along one side of the head and may be of suitable thickness so as to facilitate cleaning of glass surfaces, such as windows or the like.

The head may also be provided with a substantially longitudinally extending groove adapted to receive and to hold an edge of a steel blade suitable for removing ice form a motor vehicle's windscreen.

The handbrush may be made of a suitable polymeric material, such as rubber, and the composition of the rubber may be determined such that, upon vulcanisation, its hardness, as may be expressed by the Shore hardness, is appropriate for use of the handbrush in cleaning (including brushing and washing) different parts of motor vehicles. A Shore hardness (as measured on the A scale) of between 55 and 65, preferably around 60 has been found to yield good results. Another important parameter of the handbrush is its elongation at break.

As compared to other rubber products, the compound has to be formulated such as to have a rather high yield strength or elongation at break when vulcanised. I have found that an elongation at break of between about 550% and about 650% is required to yield good results in terms of mouldability and brushing performance. The preferred value for elongation at break is around 600%. For washing purposes, the handbrush may be provided with a cavity in its head, an inlet opening for introducing a washing or waxing aid into the cavity, closure means for closing the inlet opening, and passages interconnecting the cavity with the exterior of the head in the region of the bristles, so that a suitable liquid or solid washing or waxing aid, such as a wetting agent, a soap, a detergent, a waxing liquid or the like, may be placed in the cavity and applied to a vehicle or the like during washing thereof.

BRIEF DESCRIPTION OF THE DRAWINGS

The invention will now be described, by way of example, with reference to the accompanying drawings, in which.

DETAILED DESCRIPTION OF THE DRAWINGS

Figure 1:
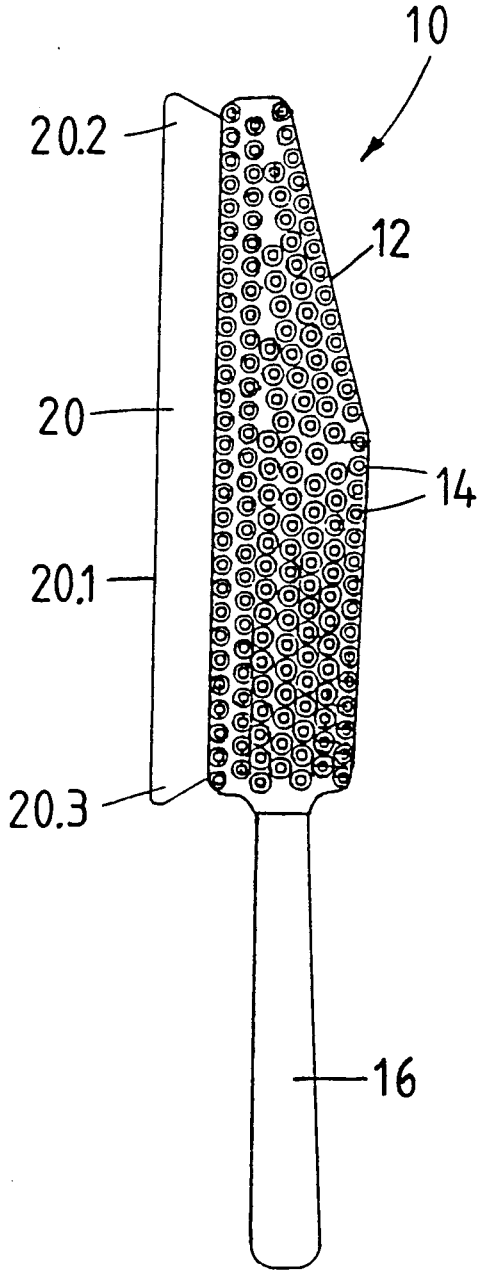
FIG. 1 is an underneath plan view of one handbrush according to the invention.

In the drawings, reference numeral 10 generally indicates a handbrush comprising an elongate head 12 with a plurality of bristles 14 thereon and a handle 16 extending from one end of the head 12. The brush 10 comprising the head 12, the bristles 14 and the handle 16, is integrally moulded in one piece, from a rubber compound, formulated such as to provide to the brush the desired hardness, longevity, mouldability and rigidity of the bristles.

A strengthening member in the form of a spring steel rod 18, which is bent as shown at 18.1, is embedded in the brush 10. The rod 18 serves to impart rigidity to the handle 16 and the head 12 and to maintain the handle 16 at a desired angle with respect to the head 12.

The handbrush 10 may be used for cleaning (including washing and brushing) upholstery, clothing, carpets, dishes, pets and horses.

Figure 2:
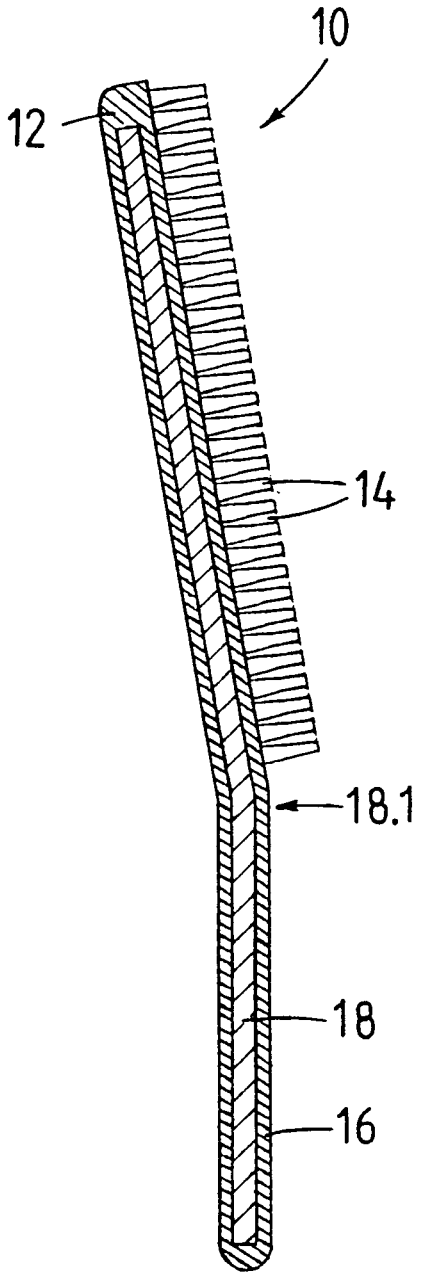
FIG. 2 is a sectional side view of the brush of FIG. 1.

The bristles 14 are of circular cross section and are tapered in a direction away from the head as is shown in FIG. 2. The bristles 14 are arranged in rows as can be seen in FIG. 1. The bristles in one row are staggered with respect to bristles in adjacent rows. The handbrush 10, in other embodiments of the invention, comprises bristles 14 of smaller diameter and bristles 14 of larger diameter, all bristles 14 having substantially the same lenght. The head 12 is provided with a scraper blade 20 which is also integrally moulded together with the head 12, the bristles 14 and the handle 16. The scraper blade 20 extends longitudinally along one of the long sides of the head 12 and is of a suitable thickness so as to facilitate cleaning of glass surfaces, such as windows or the like, with its free edge 20.1. The free edge 20.1 is preferably substantially straight.

Figure 3:
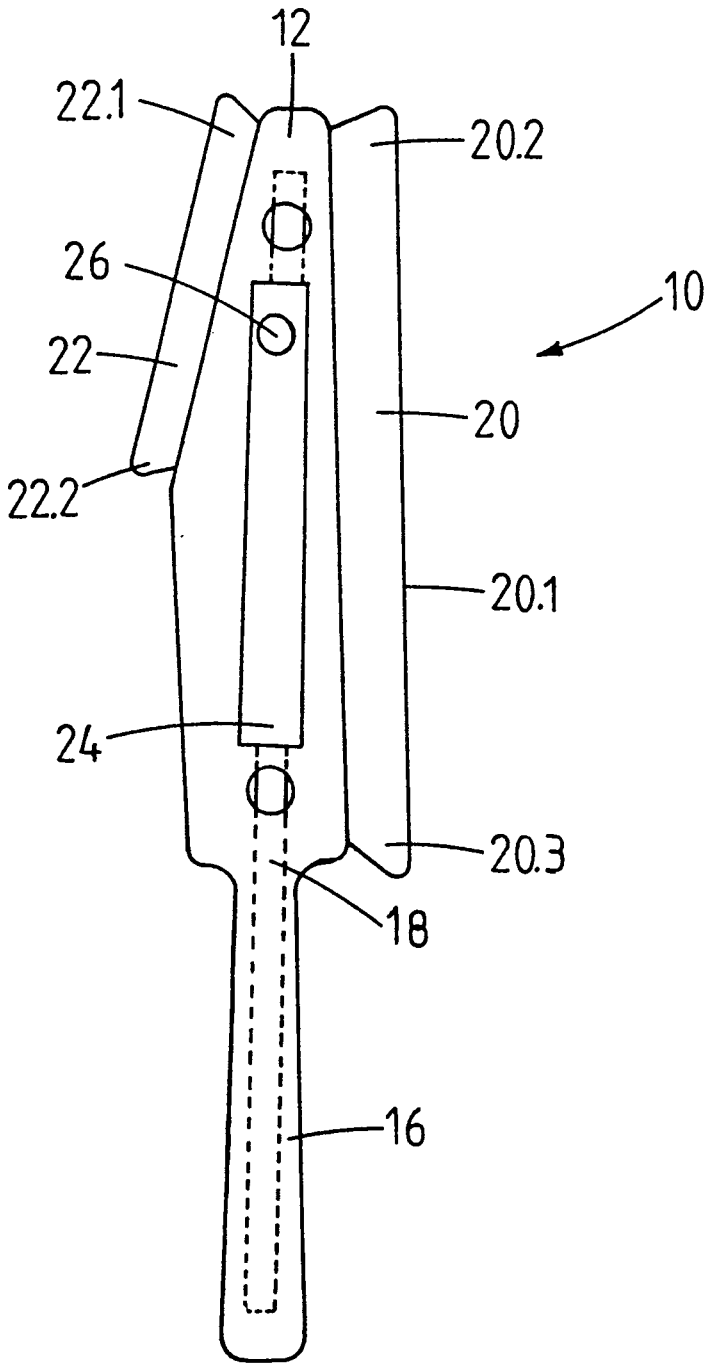
FIG. 3 is a plan view of another handbrush in accordance with the invention.

The head 12 is also provided with a substantially longitudinally extending groove on its long side opposite the side which is provided with the scraper blade 20. The longitudinally extending groove is adapted to receive and to hold an edge of a steel blade 22 as is shown in FIG. 3, suitable for removing ice from a motor vehicle's windscreen.

The corners 20.2, 20.3 and 22.1, 22.2 of respectively the scraper blade 20 and the steel blade 22 are acute so as to facilitate entry into corners. The angles of the corners 20.2, 20.3 and 22.1, 22.2 are preferably all between 45° and 75°, more preferably around 60°.

Figure 4:
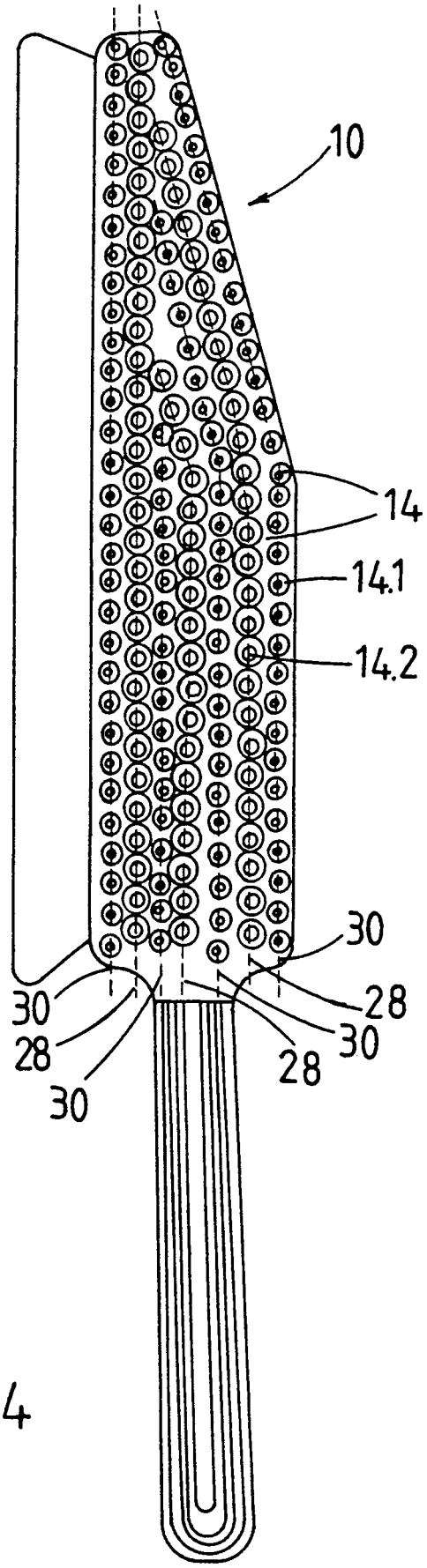
FIG. 4 is an underneath plan view of another embodiment of the hand brush in accordance with the invention.

Referring to FIG. 4, like reference numerals refer to like parts. The handbrush 10 as shown in this Figure is the same as the one shown in FIG. 1, except that some of the bristles 14, namely: bristles 14.1, are of smaller diameter (or thinner), while others, namely: bristles 14.2, are of larger diameter (or are thicker). All bristles (14.1 and 14.2) are of substantially the same length. The thicker bristles 14.2 are arranged in first rows as indicated by the dotted lines 28, while the thinner bristles 14.1 are arranged in second rows as indicated by the dotted lines 20. The second rows 30 alternate with the first rows 28. As can be seen in FIG. 4, the bristles 14.1 of one second row 30 are staggered with respect to the bristles 14.2 of an adjacent first row 28.

The handbrush is made of a rubber compound, the composition of which is determined such that, upon vulcanisation, its hardness as may be expressed by the Shore hardness, is appropriate for use of the handbrush in cleaning (including brushing and washing) different parts of sensitive surface such as of motor vehicles, whilst still maintaining sufficient rigidity of the bristles 14 and scraper blade 20 to satisfactorily perform the functions of a brush. It is also of specific importance that care should be taken that the hardness of the handbrush is not so much as to be likely to damage the paint work of motor vehicles.

For washing purposes, the handbrush 10 is provided with a cavity 24 in the head 12, an inlet opening 26 for introducing a washing or waxing aid into the cavity 24, closure means (not shown) for closing the inlet opening, and passages interconnecting the cavity 24 with the exterior of the head in the region of the bristles 14, so that a suitable liquid or solid washing or waxing aid such as a wetting agent, a soap, a detergent, a waxing liquid or the like may be placed in the cavity and applied to a vehicle, animal or other object or article during washing thereof.

The claims which follow are to be considered an integral part of the disclosure.

I claim:

1. A handbrush comprising a head, a handle connected to the head, a rigid strengthening member imbedded in the head and in the handle, and a plurality of bristles projecting from the head; the head, the handle and the bristles being all integrally molded in one piece from an unvulcanized rubber compound formulated to impart to the handbrush, upon vulcanization thereof, a Shore hardness of between 55 and 65.

2. A handbrush as claimed in claim 1, in which the head is elongate in shape and the handle extends from one end of the head, the strengthening member comprising a spring steel rod bent such as to cause the handle to be disposed at an obtuse angle to the head.

3. A handbrush as claimed in claim 1, comprising a scraper blade for cleaning glass surfaces, the scraper blade being moulded together with the head, bristles and handle as one integral piece, extending longitudinally along a long side of the head, having a suitable thickness and having a substantially straight free edge.

4. A handbrush as claimed in claim 3, comprising a steel blade for removing ice from a motor vehicle's windscreen, the head being provided with a substantially longitudinally extending groove on a long side thereof opposite the side provided with the scraper blade, the longitudinally extending groove being adapted to receive and to hold the steel blade.

5. A handbrush comprising a head, a handle connected to the head, a rigid strengthening member imbedded in the head and in the handle, and a plurality of bristles projecting from the head; the head, the handle and the bristles being all integrally molded in one piece from a rubber component formulated to impart to the handbrush, upon vulcanization thereof, an elongation at break of between 550% and 660%.

6. A method of manufacturing a hairbrush comprising a head, a handle connected to the head, a rigid strengthening member embedded in the head and in the handle, and a plurality of bristles projecting from the head; the head, the handle and the bristles being integrally molded in one piece from a suitable unvulcanized rubber compound; the method including the steps of: molding the head, the handle and the bristles as one integral part from a suitable unvulcanized rubber compound; embedding in the head and the handle the rigid strengthening member; and vulcanizing the handbrush so as to impart to it a Shore hardness of between 55 and 65 (as measured on the A scale) and an elongation at break of between 550% and 660%.

* * * * *